US008944339B2

(12) United States Patent
Ostendorff et al.

(10) Patent No.: US 8,944,339 B2
(45) Date of Patent: Feb. 3, 2015

(54) TOY VEHICLE TRACK SET

(75) Inventors: Eric Ostendorff, Torrance, CA (US); Kevin Cao, Reseda, CA (US)

(73) Assignee: Mattel, Inc., El Segundo, CA (US)

( * ) Notice: Subject to any disclaimer, the term of this patent is extended or adjusted under 35 U.S.C. 154(b) by 227 days.

(21) Appl. No.: 13/596,263

(22) Filed: Aug. 28, 2012

(65) Prior Publication Data

US 2013/0221120 A1 Aug. 29, 2013

Related U.S. Application Data

(60) Provisional application No. 61/528,496, filed on Aug. 29, 2011.

(51) Int. Cl.
*E01B 23/00* (2006.01)
*A63H 18/02* (2006.01)

(52) U.S. Cl.
CPC ..... *A63H 18/028* (2013.01); *A63H 18/026* (2013.01)
USPC ..... 238/10 E; 238/10 A

(58) Field of Classification Search
USPC ..... 238/10 A, 10 E, 10 F
See application file for complete search history.

(56) References Cited

U.S. PATENT DOCUMENTS

| | | | | |
|---|---|---|---|---|
| 3,376,844 | A | 4/1968 | Wood | |
| 3,502,332 | A | 3/1970 | Wolf | |
| 3,565,430 | A | 2/1971 | McRoskey | |
| 3,618,947 | A | 11/1971 | Cooper et al. | |
| 3,674,269 | A | 7/1972 | Cooper et al. | |
| 3,762,095 | A | 10/1973 | Merino et al. | |
| 3,789,543 | A | 2/1974 | Kirby | |
| 3,858,875 | A | 1/1975 | Nemeth et al. | |
| 3,984,939 | A | 10/1976 | Wolgamot et al. | |
| 3,986,717 | A | 10/1976 | Kirby et al. | |
| 4,077,628 | A | 3/1978 | Hebert | |
| 4,094,089 | A | 6/1978 | Sano | |
| 4,108,437 | A | 8/1978 | DeAnda et al. | |
| 4,251,949 | A | 2/1981 | Buck et al. | |
| 4,291,878 | A | 9/1981 | Nagel et al. | |
| 4,383,688 | A | 5/1983 | Prehodka | |
| 4,550,910 | A | 11/1985 | Goldfarb et al. | |
| 4,558,867 | A * | 12/1985 | Hippely | 273/412 |
| 4,605,229 | A | 8/1986 | McKay | |

(Continued)

FOREIGN PATENT DOCUMENTS

| | | | |
|---|---|---|---|
| EP | 0025304 | 8/1980 | |
| EP | 1184063 A2 * | 3/2002 | A63H 18/02 |

OTHER PUBLICATIONS

Written Opinion for French Application 1258015.

(Continued)

*Primary Examiner* — Jason C Smith
(74) *Attorney, Agent, or Firm* — Cantor Colburn LLP

(57) ABSTRACT

A track set for toy vehicles is provided herein, the track set having: a first track segment coupled to a first curved track segment; a second track segment coupled to a second curved track segment; a third curved track segment having an inlet end and an outlet end, the inlet end being wider than the outlet end, the inlet end being configured to receive the toy vehicles traveling on the first curved track segment and the second curved track segment; and a snare trap mechanism located at the outlet end of the third curved track segment, wherein the snare trap mechanism is configured to capture a first one of the toy vehicles traveling through the outlet end of the third curved track segment.

20 Claims, 11 Drawing Sheets

(56) References Cited

U.S. PATENT DOCUMENTS

| | | | | |
|---|---|---|---|---|
| 4,715,602 | A | 12/1987 | May et al. | |
| 4,872,680 | A | 10/1989 | Dennis | |
| 5,102,133 | A * | 4/1992 | Chilton et al. | 238/10 F |
| 5,152,528 | A | 10/1992 | Pasewalk | |
| 5,542,668 | A | 8/1996 | Casale et al. | |
| 6,358,112 | B1 | 3/2002 | Lambert et al. | |
| 6,913,508 | B2 | 7/2005 | Hornsby et al. | |
| 7,241,223 | B1 | 7/2007 | Caudill | |
| 7,285,035 | B1 | 10/2007 | Tullis | |
| 7,628,674 | B2 | 12/2009 | Nuttall et al. | |
| 7,637,796 | B2 | 12/2009 | Hippely | |
| 7,651,398 | B2 | 1/2010 | Ostendorff et al. | |
| 7,794,301 | B2 | 9/2010 | Ostendorff et al. | |
| 7,892,068 | B2 | 2/2011 | Nuttall et al. | |
| 8,567,690 | B2 * | 10/2013 | De La Torre | 238/10 E |
| 2002/0072294 | A1 * | 6/2002 | Hornsby et al. | 446/465 |
| 2005/0287915 | A1 | 12/2005 | Sheltman et al. | |
| 2005/0287919 | A1 * | 12/2005 | Sheltman et al. | 446/444 |
| 2009/0130946 | A1 | 5/2009 | Fink et al. | |
| 2010/0184353 | A1 | 7/2010 | Jobe | |
| 2010/0291833 | A1 * | 11/2010 | O'Connor et al. | 446/429 |
| 2010/0330868 | A1 | 12/2010 | Payne | |
| 2011/0086574 | A1 * | 4/2011 | Nuttall et al. | 446/429 |
| 2011/0124265 | A1 * | 5/2011 | O'Connor et al. | 446/429 |
| 2013/0221120 | A1 * | 8/2013 | Ostendorff et al. | 238/10 A |

OTHER PUBLICATIONS

Search Report for French Application 1258015.

* cited by examiner

TOY VEHICLE TRACK SET

CROSS REFERENCE TO RELATED APPLICATIONS

This application claims the benefit of U.S. Provisional Patent Application Ser. No. 61/528,496 filed Aug. 29, 2011, the contents of which are incorporated herein by reference thereto.

BACKGROUND

Play sets for toy vehicles are popular toys which are known to provide entertainment and excitement to a user. These play sets typically include some type of track configuration intended to guide a propelled toy vehicle, such as a 1/64 scale die-cast metal toy vehicle, through a course. The track configurations may include closed-loop continuous track arrangements and open-end arrangements. Toy vehicles are placed on these play set tracks and propelled across the configuration by hand or by an external propulsion means. In some applications, one or more users race the toy vehicles against each other and accordingly it is desirable to determine which toy vehicle won the race.

To bring increased entertainment and excitement to play sets, track configurations may include features such as intersecting tracks, loop segments, and other types of track configurations.

Accordingly, it is desirable to provide a play set for toy vehicles that has a unique apparatus and method for determining a winner of the race.

BRIEF SUMMARY OF INVENTION

In one embodiment a track set for toy vehicles is provided herein, the track set having: a first track segment coupled to a first curved track segment; a second track segment coupled to a second curved track segment; a third curved track segment having an inlet end and an outlet end, the inlet end being wider than the outlet end, the inlet end being configured to receive the toy vehicles traveling on the first curved track segment and the second curved track segment; and a snare trap mechanism located at the outlet end of the third curved track segment, wherein the snare trap mechanism is configured to capture a first one of the toy vehicles traveling through the outlet end of the third curved track segment.

In another exemplary embodiment a track set for toy vehicles is provided, the track set having: a first track section comprising a first track segment and a second track segment arranged such that side-by-side racing of toy vehicles thereon may occur; a loop section configured to receive toy vehicles from the first track section, the loop section comprising a first curved track segment and a second curved track segment each having a distal end spaced from an inlet end of a third curved track segment, the inlet end being wider than an outlet end of the third curved track segment; and a snare trap mechanism located at the outlet end of the third curved track segment, wherein the snare trap mechanism is configured to capture a first one of the toy vehicles traveling through the outlet end of the third curved track segment.

In still yet another exemplary embodiment a track set for toy vehicles is provided, the track set having: a first track section comprising a first track segment and a second track segment arranged such that side-by-side racing of toy vehicles thereon may occur; a loop section configured to receive toy vehicles from the first track section, the loop section comprising a first curved track segment and a second curved track segment each having a distal end spaced from an inlet end of a third curved track segment, the inlet end being wider than an outlet end of the third curved track segment; and a snare trap mechanism located at the outlet end of the third curved track segment, wherein the snare trap mechanism is configured to capture a second one of the toy vehicles traveling through the outlet end of the third curved track segment.

In yet another embodiment, a track set for toy vehicles is provided. The track set having: a first track section arranged such that side-by-side racing of toy vehicles thereon may occur; a ramp section movably mounted to the track set for movement between a first position and a second position, wherein the ramp section is configured to receive toy vehicles from the first track section when the ramp section is in the second position and wherein the ramp section is located above the first track section when it is in the first position such that toy vehicles traveling on the first track section will not be received on the ramp section, and wherein the ramp section is configured to launch the toy vehicles traveling on the ramp section upwardly and away from the ramp section; and a snare trap mechanism located above the ramp section, wherein the snare trap mechanism is configured to capture a first one of the toy vehicles traveling upwardly and away from the ramp section.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

In accordance with an exemplary embodiment of the present a side-by-side racing track set is provided. The track set has a pair of manually controlled vehicle launchers for each racing lane of the track set. In addition, the track incorporates a fair start gate that lifts to commence the race. If a vehicle is released before the fair start gate lifts, that vehicle is launched off the track.

In addition, the track set further comprises a snare situated at the end of the track where the two independent lanes combine into one, for capturing the lead vehicle and announcing a winner of the race. Additional alternative features include: a) a bear trap situated beyond the track to capture the losing vehicle; and b) a checkered flag adapted to rise when a winning vehicle is "snared".

Figures 1, 1A:
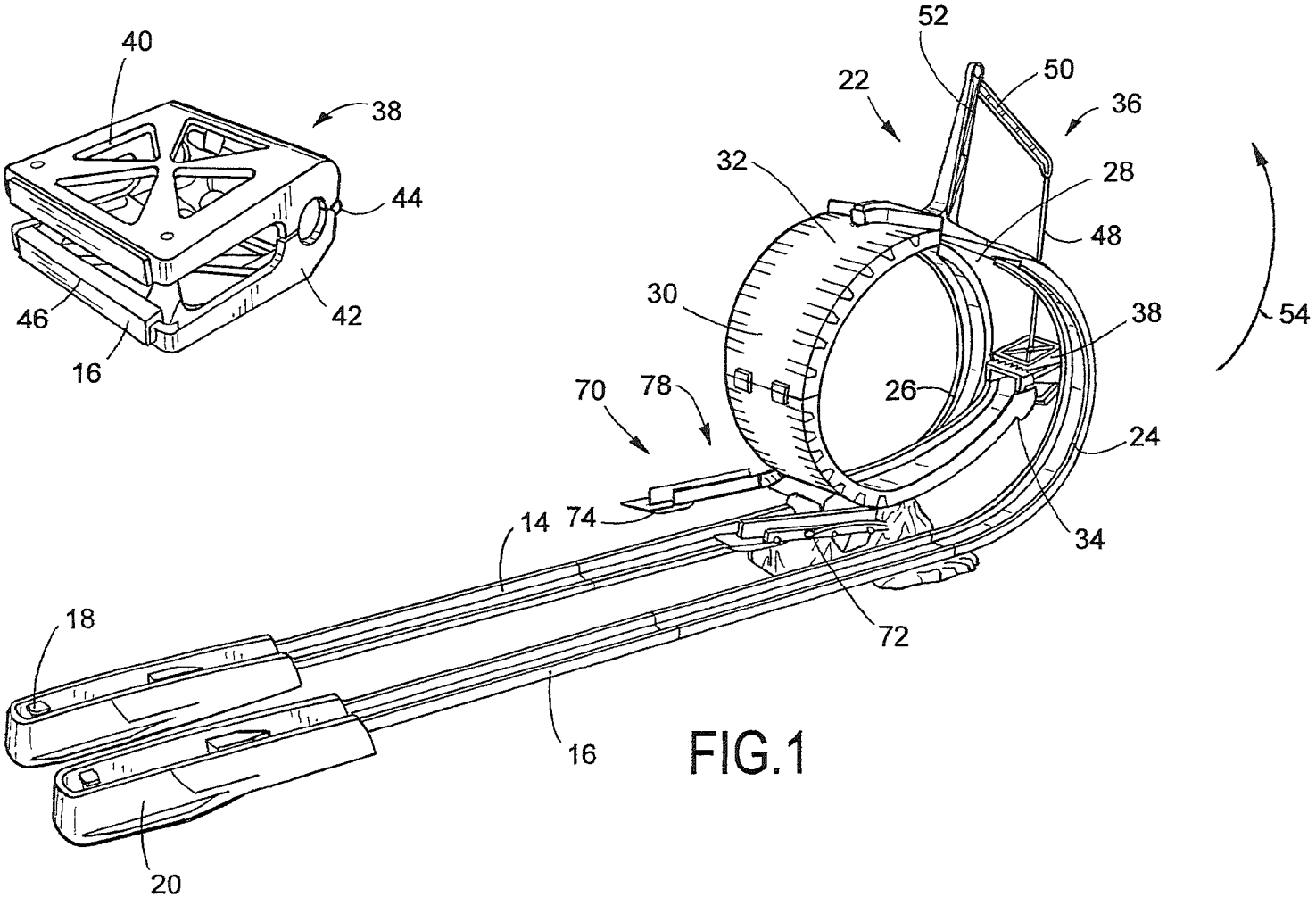
FIG. 1 is a perspective view of a play set according to an exemplary embodiment of the present invention.
Figure 2A:
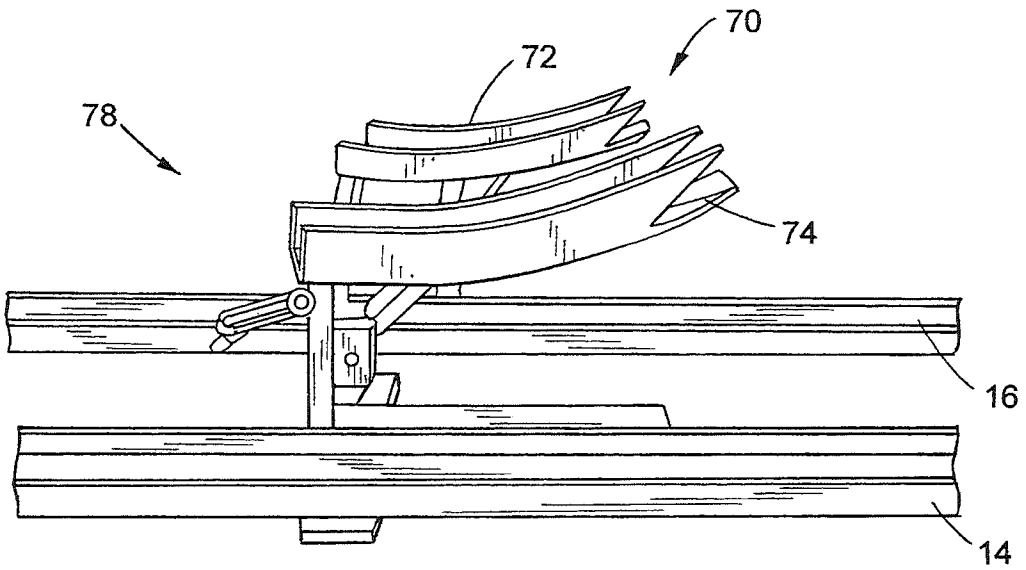
FIGS. 2A-2D are perspective views of a fair start mechanism for use in an exemplary embodiment of the present invention.
Figure 2B:
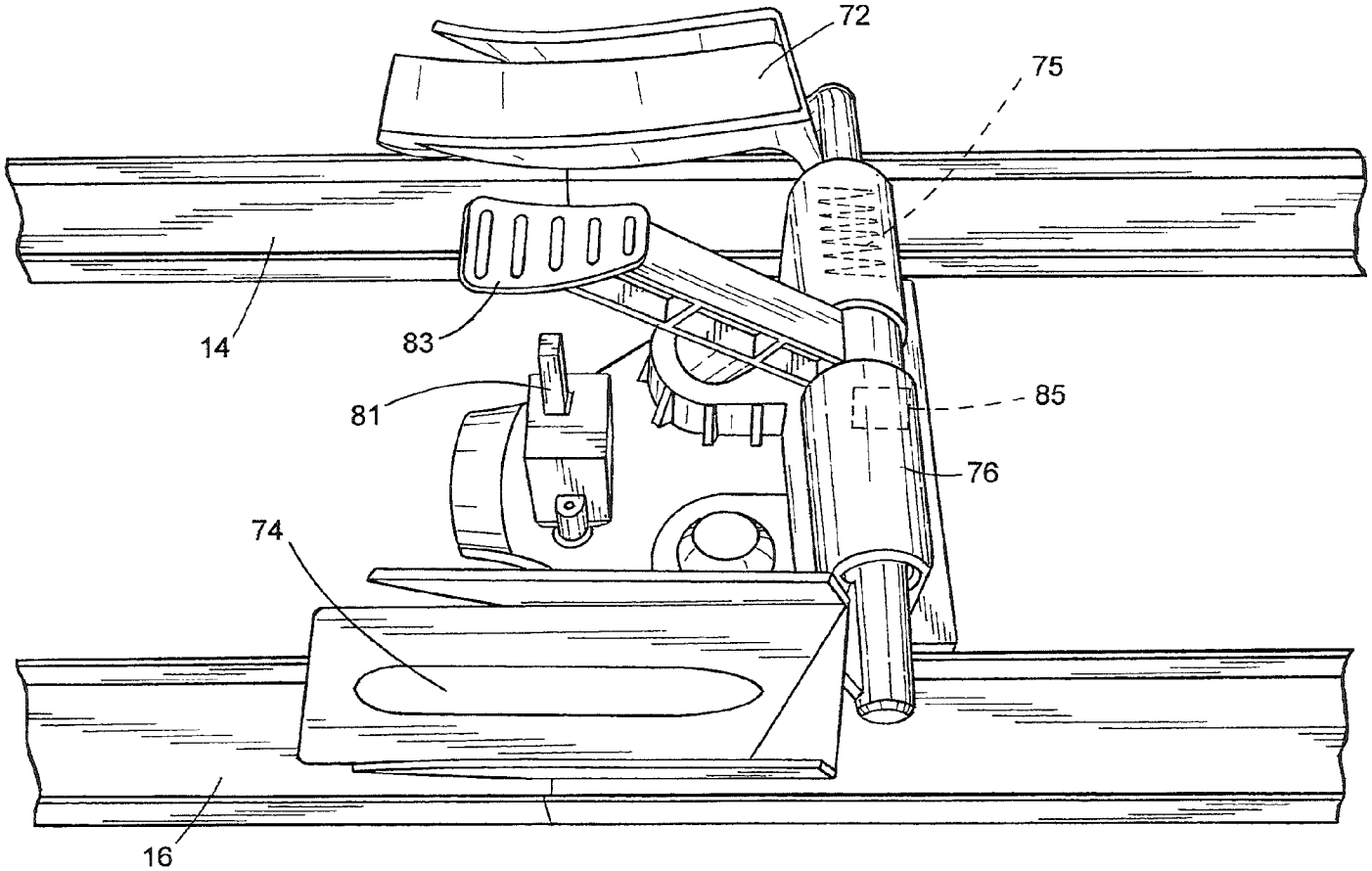
Figure 2C:
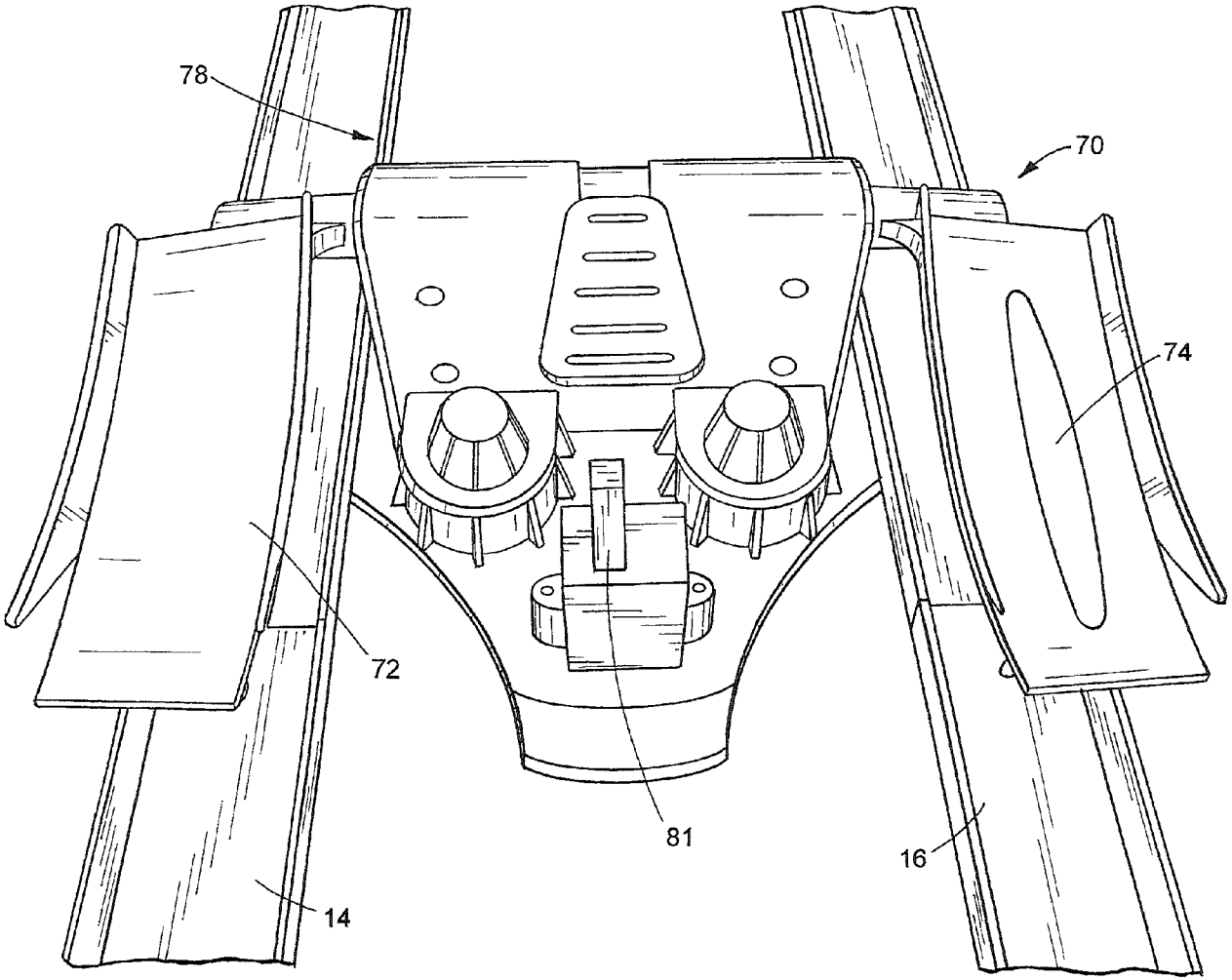
Figure 2D:
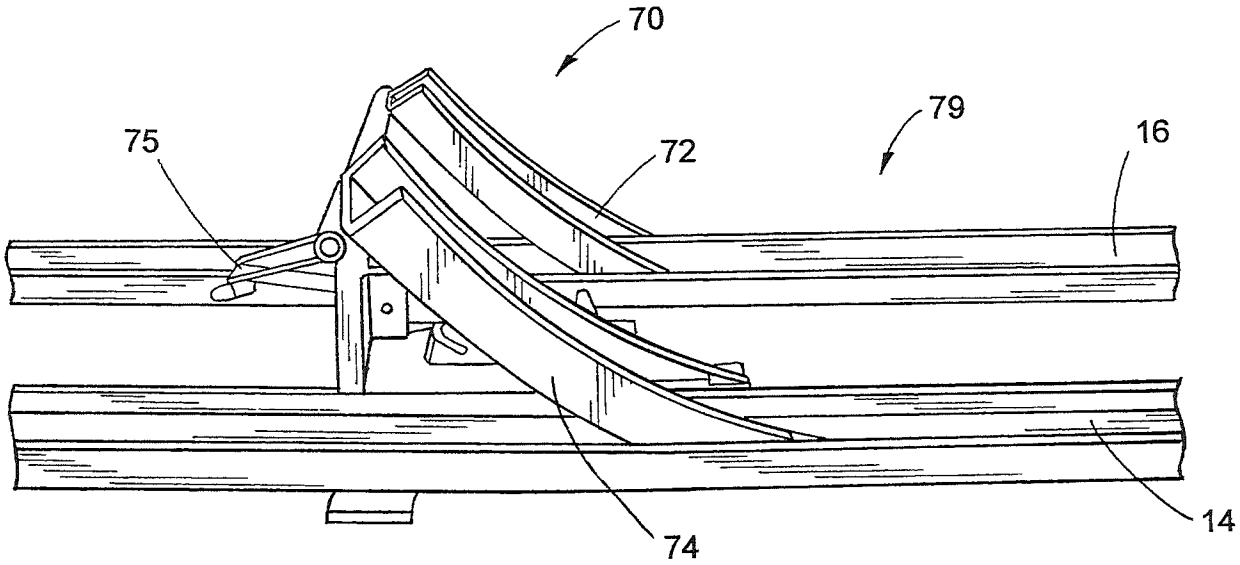
Figure 3:
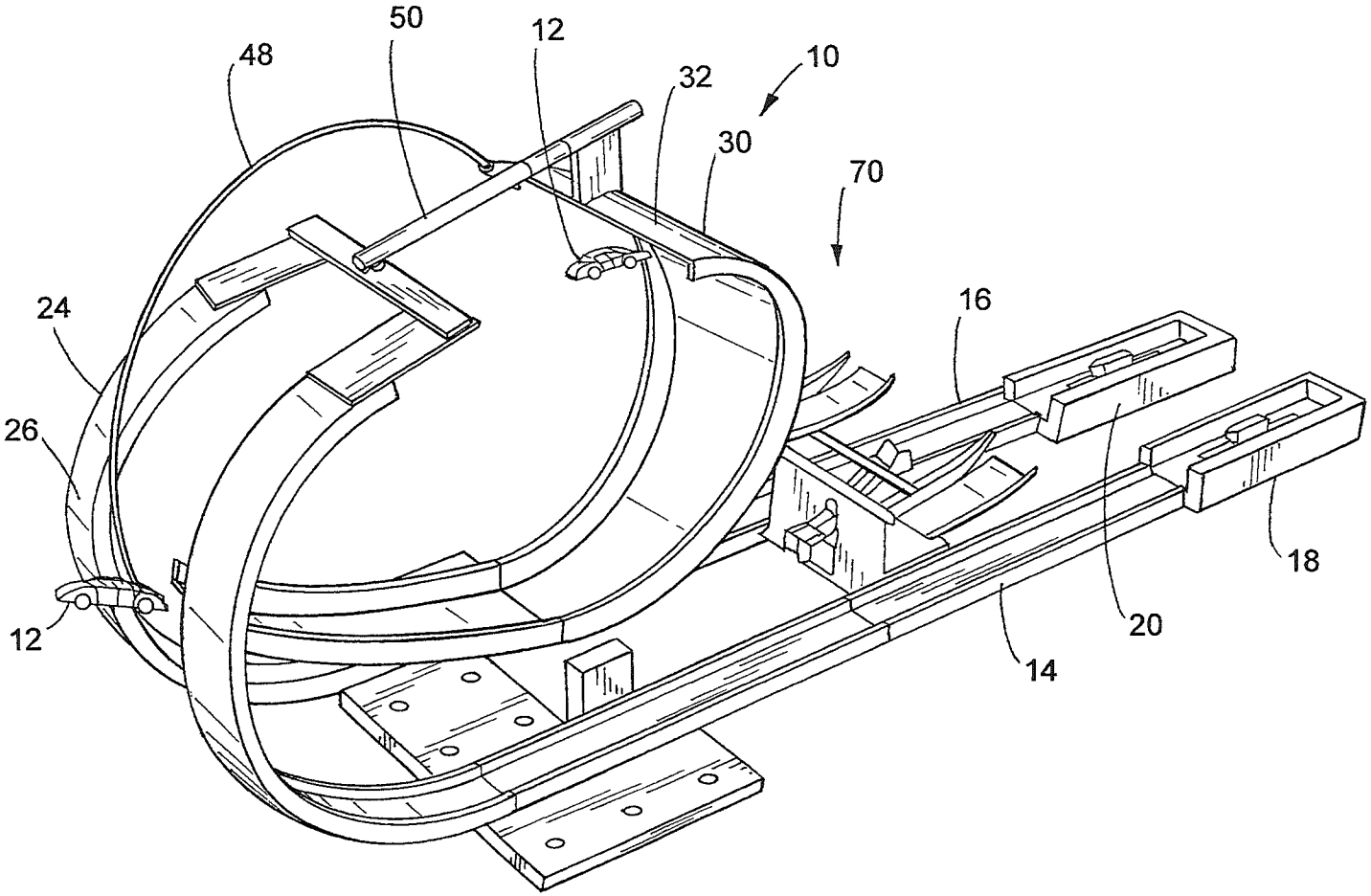
FIGS. 3-7 illustrate various perspective views of the play set as toy vehicles travel thereon.

FIG. 1 shows an exemplary play set or track set 10 for toy vehicles or objects 12 according to one non-limiting embodiment of the present invention. The play set 10 includes two independent track segment or sections 14 and 16 each having a launcher 18, 20 at one end of the track section. Launchers 18 and 20 are mechanical launchers such as a spring biased mechanism that are configured to propel the vehicles 12 along a respective track segment. Non-limiting examples of suitable launchers are described in U.S. Pat. Nos. 4,108,437 and 6,435,929 and U.S. Patent Publication No. 2007/0293122, the contents each of which are incorporated herein by reference thereto.

At an opposite end of the track segments 14 and 16 a loop section 22 is provided. Loop section 22 has a pair of curved track segments 24 and 26. Each of the curved segments 24 and 26 are coupled to a respective one of the track segments 14 and 16 at one end and each of the pair of curved track segments 24 and 26 terminate at a distal end such that a gap 28 is formed between the distal ends of the curved track segments 24 and 26 with a single curved track segment 30 configured to receive the toy vehicles therein after they have traversed gap 28 between curved track segments 24 and 26 and the single curved track segment 30.

As illustrated, the single curved track segment 30 has a wide inlet 32 and a narrow outlet end 34 such that the curved track segment 30 converges from a wide width to a narrow width thus funneling the toy vehicles into the narrow outlet end 34.

In accordance with one exemplary embodiment of the present invention, the first toy vehicle to traverse gap 28 and arrive at the narrow outlet end 34 is deemed the winner of the race. Since the toy vehicles 12 may arrive at the finish line (e.g., narrow outlet end) at substantially the same time it is desirable to have a means or apparatus to determine which toy vehicle has crossed the finish line first.

In an exemplary embodiment, a vehicle snare apparatus 36 is provided. In one embodiment, the vehicle snare apparatus 36 has a snare trap 38. Snare trap 38 has a pair of grasping members 40 and 42 each of which are pivotally secured to each other at a hinge end 44. A mouth portion 46 is provided at an opposite end of the snare trap. In one embodiment, the pair of grasping members 40 and 42 are spring biased into the closed position illustrated in FIG. 1A. In order to secure the snare trap 38 to narrow outlet end 34, each of the pair of grasping members are pivoted away from each other such that they can engage narrow outlet end 34 when they are allowed to bias back towards the closed position illustrated in FIG. 1A. Accordingly and as illustrated in FIG. 1, the pair of grasping members 40 and 42 are slightly open to provide a trap for receiving the toy vehicle therein after it has exited from end 34.

Figure 4:
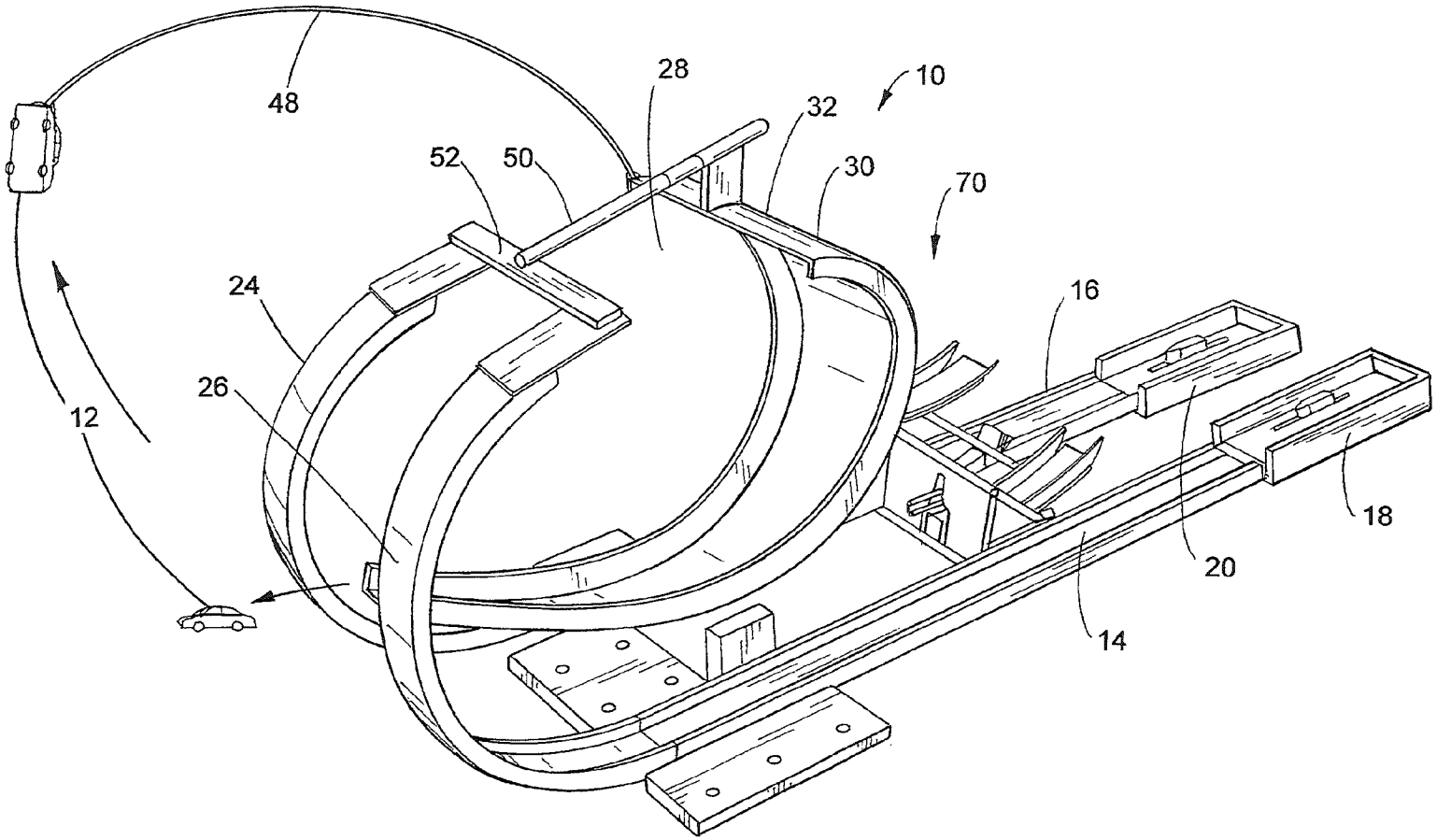

Snare trap 38 is secured to the loop section 22 via an elastic member 48 that is secured to the snare trap 38 at one end and an arm member 50 at the other. Arm member 50 is pivotally secured to a fixed structure member 52 that is secured to loop section 22. Accordingly, and through the use of the pivotally mounted arm member 50 and elastic member 48 and upward biasing force in the direction of arrow 54 is provided such that once the toy vehicle 12 is captured in the trap 38 and the same is released from the narrow outlet end 34 it is pulled upwardly in the direction of arrow 54 due to the biasing force of elastic member 48. This movement is illustrated in at least FIG. 4.

Since the snare trap 38 is positioned at the narrow outlet end 34 of the curved track segment 30, the first vehicle to reach the narrow outlet end 34 will be captured by this snare trap 38 and pulled upwardly and in the direction of arrow 54. This capture and movement of the vehicle upwardly in the air will signify the winner of the race. Thereafter and since the trap 38 is now removed from outlet end 34, the next vehicle 12 to arrive at the same will fly off the track segment 30.

Figure 5:
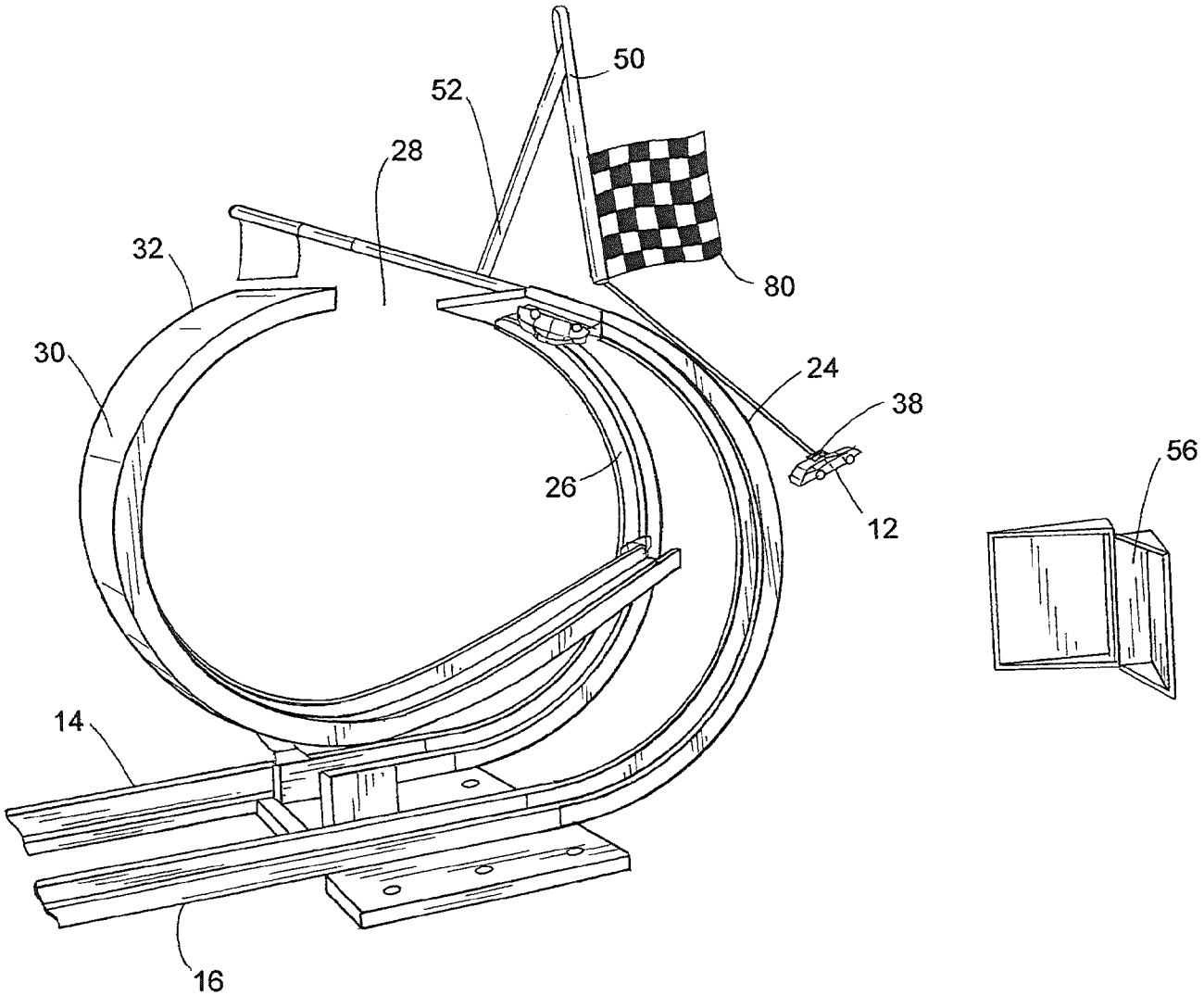
Figure 6:
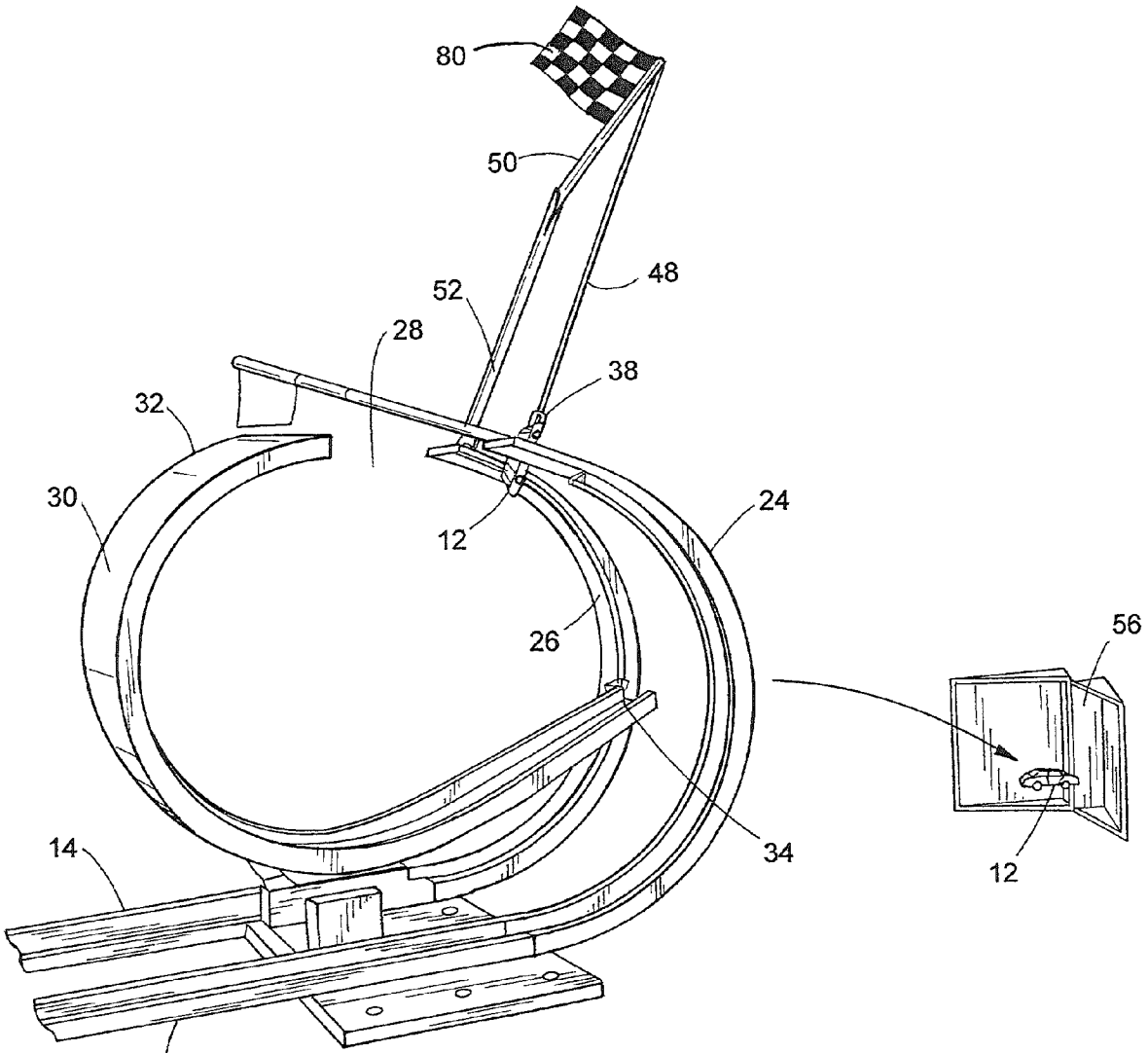
Figure 7:
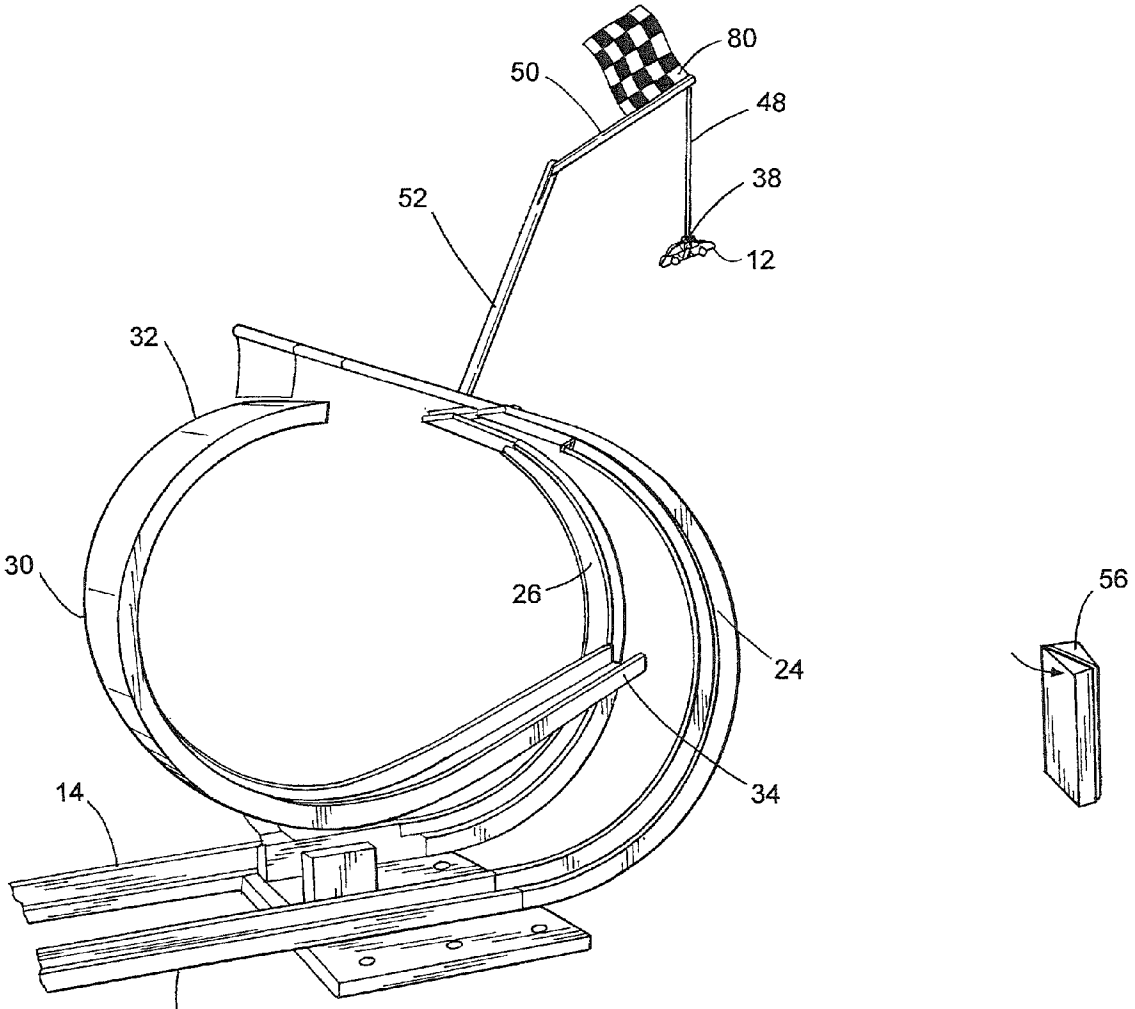

In one alternative embodiment and referring to at least FIGS. 5 and 6, another trap 56 is provided to capture the second or losing vehicle 12 which is launched from the narrow outlet end 34 after the trap 38 has been removed therefrom (e.g., due to the first or winning vehicle previously arriving at outlet end 34). In this embodiment and when the second vehicle 12 is launched from the narrow outlet end 34 it will travel through the air and contact trap 56. In one embodiment, trap 56 comprises a pair of wall members 58 and 60 pivotally secured to each other at a hinge 62. In this embodiment, the wall members 58 and 60 of the trap 56 can be positioned into an open position (FIG. 5) wherein a spring biasing or spring biased closing force is held at bay until the vehicle 12 contacts the trap (FIG. 6). At this point, the biasing force will be released and the wall members 58 and 60 will move towards each other and closed the trap 56 thus, capturing the vehicle 12.

Accordingly, and as toy vehicles 12 are launched down their respective track segments of the track set they will enter a respective curved track segment which will invert and direct the toy vehicles towards loop segment 30, which in one embodiment converges into narrow outlet end 34 and thus provides a finish line with a mechanism (snare trap 38) located thereon to determine which one of the racing vehicles reaches the finish line first. As described above, the winning vehicle is captured by the snare trap pulled upward into the air while the losing vehicle careens off of the narrow outlet end into the undesirable trap 56.

Alternatively, the play set or track set may be configured within an alternative arrangement instead of trap 56 such as a bucket or receptacle that the losing vehicle lands in.

In addition and in still yet another alternative embodiment and since the distal ends of curved track segments 24 and 26 are spaced from a distal end of curved track segment 30, and the curved track segments 24 and 26 and curved track segment 30 are formed from a flexible materials such as plastic or of equivalents thereof, an adjustable gap 28 is provided. This adjustable gap 28 can be enlarged or reduced by using an adjustable member which is secured to each of the distal ends of the curved track segments and in one embodiment may form a portion of the structure 52 pivotally supporting arm member 50.

In still yet another alternative embodiment, operation of the snare trap 38 can be reversed such that the first vehicle to travel through narrow outlet end 34 is not captured by the snare trap 38 and only the losing or second vehicle to reach the narrow outlet end is captured by the snare trap 38. This could be achieved by having an opening in the snare trap that allows the first vehicle to travel therethrough and a release mechanism is positioned within or proximate to the snare trap 38 such that the second arriving vehicle will actuate this mechanism and cause the snare trap 38 to capture the second or losing vehicle. In other words, the first or winning vehicle 12 will prime or load the snare trap 38 such that the second vehicle to arrive at the snare trap 38 will be captured.

Referring back now to FIGS. 1-4 and in particular FIGS. 2A-2D a fair start mechanism 70 is illustrated. In accordance with an exemplary embodiment of the present invention, the fair start mechanism 70 provides a means for preventing one of the users from launching their toy vehicle 12 too early. The fair start mechanism has a pair of track sections 72 and 74 each of which are pivotally mounted to a structure 76 such that the pair of track section 72 and 74 are capable of movement from a first non-blocking position 78 illustrated in FIGS. 2A-2C and a blocking position 79 illustrated in FIG. 2D. When the pair of track sections 72 and 74 are in the blocking position they are aligned with track sections 14 and 16 such that if a toy vehicle reaches one of the pair of track sections when they are in the blocking position, the toy vehicle will travel on to the one of a pair of track sections and be launched off of the play set.

Alternatively and if the pair of track sections are in the non-blocking position, the toy vehicle will travel underneath one of the pair of track sections and proceed onward to the loop section 22.

Accordingly, the fair start mechanism provides a means for causing a user to not be too overzealous and launch their toy vehicle from the launcher too soon as they will be ejected off of the track section should they launch their vehicle before the appropriate time dictated by the fair start mechanism. Furthermore and in an effort to provide even more play enhancement, the fair start mechanism 70 is configured to have a slow release mechanism that will hold the fair start mechanism 70 in the blocking position for a few seconds before it is released to move back into the non-blocking position.

This is achieved by providing a spring biasing force to the pair of track sections 72 and 74 such that they are urged into the non-blocking position illustrated in the attached figures. Accordingly and when a user applies a force to the pair of track sections 72 and 74 to urge them into the blocking position the pair of track sections 72 and 74 are held in this position for a limited amount of time and then they are released and the spring biasing force urges them back into the non-blocking position. One non-limiting way to achieve this is to provide a resilient member 81 (e.g., shape memory foam, elastic biasing member, spring etc.) that is compressed when a lever coupled to the pair of track sections 72 and 74 is rotated into the blocking position. Once this occurs a catch 85 will hold the pair of track sections or a portion of lever 83 in this position until the compressed resilient member returns back to its uncompressed configuration which causes the pair of track sections 72 and 74 to rotate back towards the non-blocking position and also cause the catch to no longer retard the biasing force which urges the pair of track sections 72 and 74 back into the non-blocking position. Alternatively, a spring 75 can be located in the fair start mechanism to provide the spring biasing force, of course, numerous other means for providing the spring biasing force are contemplated to be within the scope of exemplary embodiments of the present invention.

In addition and in an alternative embodiment, the arm member 50 can be configured with a flag 80 such that once the snare trap 38 is released and moved upwardly in the air flag 80 can be deployed further signifying the winner of the race.

Figure 8:
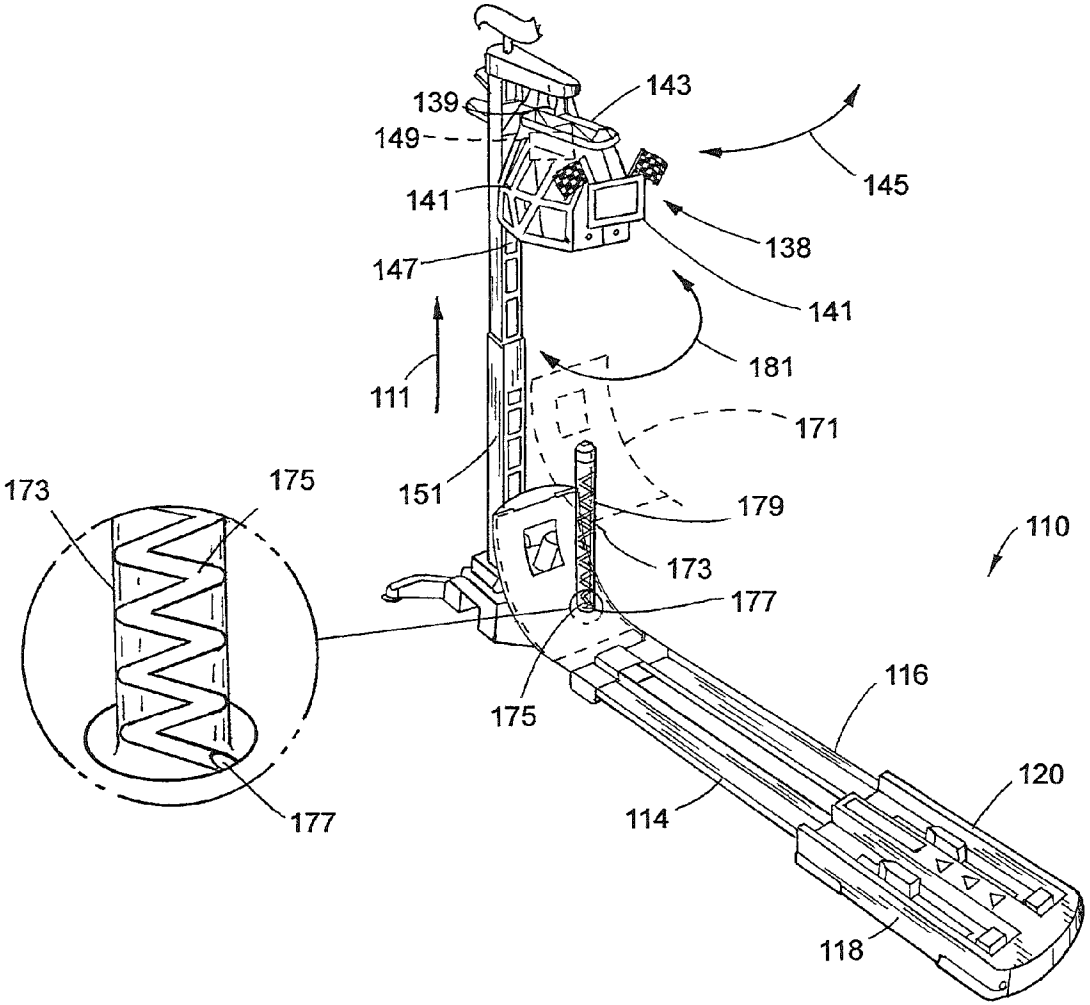
FIG. 8 illustrates an alternative embodiment of the present invention.

Referring now to FIG. 8, yet another alternative embodiment of the present invention is illustrated. Similar to the previous embodiments, the track set 110 has two side-by-side vehicle launchers 118 and 120 and a fair start mechanism 170. However, after the vehicles are launched from the launchers 118 and 120 and if the fair start mechanism is in the position illustrated in FIG. 8, the launched vehicles are vertically directed in the direction of arrow 111 to a bear-trap type cage 138 which closes upon receiving the first vehicle to reach the cage 138. The second vehicle to reach the cage or non-captured vehicle falls to the ground since the cage 138 is closed by the first vehicle. Thus, the cage 138 provides a means for indicating which one of the toy vehicles has won the race. For example, the first toy vehicle to be launched upwardly away from the fair start mechanism 170 will enter the cage and the second car or loser of the race will be prevented from entering the cage. In the event of a tie both the launched vehicles are captured by the cage 138. In other words, cage 138 is configured to at least in one embodiment, capture to vehicles should they enter the open cage at the same time.

Similar to the previous embodiments, the cage 138 will have a sensitive trigger (over center or otherwise) that is able to quickly close and reliably trap the winning car/cars when they hit it. For example and in one non-limiting embodiment, the cage 138 will comprise a central body 139 having a pair of sidewalls 141 each pivotally mounted to an upper portion 143 for movement in the direction of arrows 145. FIG. 8 illustrates the pair of sidewalls 141 in a first open position such that an opening 147 is provided at a lower portion of cage 138. Opening 147 is positioned to receive toy vehicles launched from the launchers 118 and 120. As in the previous embodiments, the first vehicle to enter the opening 147 will contact a trigger or switch 149 located within cage 138, which will release the pair of sidewalls 141 and cause them to traverse from the open position to a closed position. In one non-limiting embodiment, the pair of sidewalls 141 are spring biased into the closed position by a spring and the cage is configured to have a release mechanism that will retain the sidewalls 141 in the open position and actuation of the trigger or switch 149 actuates the release mechanism which will release the sidewalls and the spring biasing force will cause the pair of sidewalls 141 to close. Of course, alternative embodiments contemplate a single door member 141 movable between an open position and a closed position and spring biased into a closed position such that actuation of the trigger 149 causes the same to move into the closed position and thus capture the vehicle(s) launched therein.

As illustrated, the cage 138 is secured to a tower member 151 such that an opening 147 is positioned above a ramp member of the fair start mechanism 170.

In this embodiment, the fair start mechanism comprises a curved section of track 171 that is movably or slidably secured to a post 173 such that it can be located between a first start position (illustrated by the dashed lines in FIG. 8) proximate to a top portion of post 173 and a second start position (illustrated by the non-dashed lines in FIG. 8) proximate to a bottom portion of post 173 such that vehicles launched from the launchers 118 and 120 will engage the curved track section 171 when it is in the second start position.

In order to allow for this movement, the curved section of track 171 has a central opening 175 configured to slidably receive post 173 therein. In one embodiment, central opening 175 has at least one protrusion 177 (e.g., a spring-loaded pin or any other equivalent member or device) that is configured to engage a grooved portion 179 of post 173. In this embodiment, the grooved portion 179 traverses from the top portion of the post 173 to the bottom portion of the post 173 in a zigzag manner such that the curved section of track 171 traverses from the first position to the second position in an oscillating manner by moving back and forth in the direction of arrows 181.

Accordingly and in order to provide a means for a fair start of two vehicles being launched by the launchers 118 and 120, the user simply moves the curved track section to the first position and releases the same such that gravity forces will pull the curved track section 171 downward in a direction opposite to arrow 111. At the same time, protrusion 177 will engage the grooved portion 179 and thus the curved track section 171 will oscillate back and forth in the directions of arrows 181 until it reaches the second position. At that time, vehicles launched from the launchers 118 and 120 will travel down track segment 114 and 116 and the launched by the curved track section 171. Accordingly, the fair start mechanism 170 provides a means that allows the users to time the launching of their vehicles from the launchers 118 and 120 such that they are launched from the ramp defined by the curved track section 171.

Alternatively, the curved track section 171 may simply be dropped from the first position to the second position in a non-oscillating manner. In this embodiment, a means for slowing the movement of the curved track section from the first position to the second position may be employed such that users are once again, able to time the launching of the vehicles from the launchers 118 and 120.

The embodiment of FIG. 8, allows at least two toy vehicles to race each other as they are launched from a pair of launchers 118 and 120 along track segments 114 and 116, the toy vehicles then jump vertically up into a bear-trap style victory cage which slams shut to catch the winning car or both cars in the event of a tie.

The fair start mechanism 170, provides a fair start feature for the race in that a curved portion of track 171 (e.g., a quarter loop) is capable of being disengaged from track segment 114 and 116 and moved upwardly on a pole or post 173 into a first or raised position such that the launching of the toy vehicles from the launchers 118 and 120 will result in a crash since a portion of the path or roadway leading to the jump into cage 138 is missing. In order to start the race, a user manually lifts the curved portion of track 171 (e.g., ramp section) up the pole or post 173 to the first position. Once this track 171 is released, the protrusion 177 will engage the zigzag cam groove 179 cut in, thus the whole ramp section oscillates back and forth as it slowly descends. This timing interval lasts several seconds and requires both users to wait until the ramp section finally falls into place, completing the roadway and enabling the drag race to start, wherein toy vehicles launched from the launchers 118 and 120 will be propelled towards the cage 138.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A track set for toy vehicles, comprising:

a first track segment coupled to a first curved track segment;

a second track segment coupled to a second curved track segment;

a third curved track segment having an inlet end and an outlet end, the inlet end being wider than the outlet end, the inlet end being configured to receive the toy vehicles traveling on the first curved track segment and the second curved track segment; and a snare trap mechanism located at the outlet end of the third curved track segment, wherein the snare trap mechanism is configured to capture a first one of the toy vehicles traveling through the outlet end of the third curved track segment, wherein the snare trap mechanism comprises, a pair of grasping members each being pivotally secured to each other at a hinge end and a mouth portion is provided at an opposite end of the snare trap, wherein the mouth portion is configured to engage the outlet end of the third curved track segment.

2. The track set as in claim 1, wherein a gap is located between the first curved track segment, the second curved track segment and the inlet end of the third curved track segment.

3. The track set as in claim 1, wherein the snare trap mechanism is coupled to another portion of the track set via an elastic member such that once the snare trap captures the first one of the toy vehicles traveling through the outlet end of the third curved track segment, the snare trap mechanism is pulled upwardly into the air.

4. The track set as in claim 1, includes a fair start mechanism, the fair start mechanism comprises a pair of track sections proximate to a respective one of the first track segment and the second track segment, each of the pair of track sections of the fair start mechanism are pivotally mounted to a structure for movement between a first non-blocking position and a second blocking position, wherein toy vehicles traveling along either one of the first track segment or the second track segment will be launched from the track set when the pair of track sections are in the blocking position.

5. The track set as in claim 4, wherein the toy vehicles traveling along either one of the first track segment or the second track segment will pass underneath one of the pair of track sections and proceed onward to one the first curved track segment or the second curved track segment the pair of track sections are in the first non-blocking position.

6. The track set as in claim 5, wherein the fair start mechanism further comprises a slow release mechanism that will hold the fair start mechanism in the first blocking position for a few seconds before it is released to move back into the second non-blocking position.

7. The track set as in claim 6, wherein the pair of track sections of the fair start mechanism are spring biased into the second non-blocking position and wherein the slow release mechanism further comprises a resilient member that is compressed when the fair start mechanism is in the second blocking position and the resilient member provides a biasing force urging a portion of the fair start mechanism back into the first non-blocking position.

8. The track set as in claim 7, wherein the resilient member is a shape memory foam.

9. The track set as in claim 1, further comprising a second snare trap mechanism remote from the outlet end of the third curved track segment, wherein the second snare trap mechanism is configured to capture a second one of the toy vehicles traveling through the outlet end of the third curved track segment.

10. The track set as in claim 1, wherein the pair of grasping members are spring biased into a closed position and the pair of grasping members are moved away from the closed position so that the mouth portion is positioned over the outlet end of the third curved track segment.

11. The track set as in claim 10, wherein the snare trap mechanism is coupled to another portion of the track set via an elastic member such that once the snare trap captures the first one of the toy vehicles traveling through the outlet end of the third curved track segment, the snare trap mechanism is pulled upwardly into the air.

12. The track set as in claim 10, wherein one end of the elastic member is secured to an arm member pivotally mounted to a portion of the track set.

13. The track set as in claim 12, wherein a flag is secured to the arm member and is raised upwardly when the snare trap captures the first one of the toy vehicles traveling through the outlet end of the third curved track segment.

14. A track set for toy vehicles, comprising:

a first track section comprising a first track segment and a second track segment arranged such that side-by-side racing of toy vehicles thereon may occur;

a loop section configured to receive toy vehicles from the first track section, the loop section comprising a first curved track segment and a second curved track segment each having a distal end spaced from an inlet end of a third curved track segment, the inlet end being wider than an outlet end of the third curved track segment; and a snare trap mechanism located at the outlet end of the third curved track segment, wherein the snare trap mechanism is configured to capture a first one of the toy vehicles traveling through the outlet end of the third curved track segment, wherein the snare trap mechanism comprises, a pair of grasping members each being pivotally secured to each other at a hinge end and a mouth portion is provided at an opposite end of the snare trap, wherein the mouth portion is configured to engage the outlet end of the third curved track segment.

15. The track set as in claim 14, wherein an adjustable gap is provided between the first curved track segment, the second curved track segment and the inlet end of the third curved track segment and the first track section further comprises a launcher for each one of the first track segment and the second track segment, the launcher being configured to propel toy vehicles along a respective one of the first track segment and the second track segment.

16. The track set as in claim 15, wherein the snare trap mechanism is coupled to another portion of the track set via an elastic member such that once the snare trap captures the first one of the toy vehicles traveling through the outlet end of the third curved track segment, the snare trap mechanism is pulled upwardly into the air.

17. The track set as in claim 16, includes a fair start mechanism, the fair start mechanism comprises a pair of track sections proximate to a respective one of the first track segment and the second track segment, each of the pair of track sections of the fair start mechanism are pivotally mounted to a structure for movement between a first non-blocking position and a second blocking position, wherein toy vehicles traveling along either one of the first track segment or the second track segment will be launched from the track set when the pair of track sections are in the blocking position.

18. The track set as in claim 17, wherein the toy vehicles traveling along either one of the first track segment or the second track segment will pass underneath one of the pair of track sections and proceed onward to one the first curved track segment or the second curved track segment the pair of track sections are in the first non-blocking position.

19. A track set for toy vehicles, comprising:

a first track section comprising a first track segment and a second track segment arranged such that side-by-side racing of toy vehicles thereon may occur;

a loop section configured to receive toy vehicles from the first track section, the loop section comprising a first curved track segment and a second curved track segment each having a distal end spaced from an inlet end of a third curved track segment, the inlet end being wider than an outlet end of the third curved track segment; and a snare trap mechanism located at the outlet end of the third curved track segment, wherein the snare trap mechanism is configured to capture a second one of the toy vehicles traveling through the outlet end of the third curved track segment.

20. A track set for toy vehicles, comprising:

a first track section arranged such that side-by-side racing of toy vehicles thereon may occur;

a ramp section movably mounted to the track set for movement between a first position and a second position, wherein the ramp section is configured to receive toy vehicles from the first track section when the ramp section is in the second position and wherein the ramp section is located above the first track section when it is in the first position such that toy vehicles traveling on the first track section will not be received on the ramp section, and wherein the ramp section is configured to launch the toy vehicles traveling on the ramp section upwardly and away from the ramp section; and a snare trap mechanism located above the ramp section, wherein the snare trap mechanism is configured to capture a first one of the toy vehicles traveling upwardly and away from the ramp section.

* * * * *